United States Patent [19]

Newby

[11] Patent Number: 4,776,388

[45] Date of Patent: Oct. 11, 1988

[54] METHOD AND APPARATUS FOR COOLING A HIGH TEMPERATURE WASTE GAS USING A JETTING BED, FLUIDIZED BED TECHNIQUE

[75] Inventor: Richard A. Newby, Pittsburgh, Pa.

[73] Assignee: Westinghouse Electric Corp., Pittsburgh, Pa.

[21] Appl. No.: 13,591

[22] Filed: Feb. 11, 1987

Related U.S. Application Data

[62] Division of Ser. No. 711,321, Mar. 13, 1985, Pat. No. 4,651,807.

[51] Int. Cl.[4] ..... F28C 3/16; F28D 13/00

[52] U.S. Cl. ..... 165/104.18; 165/104.16; 122/4 D; 34/57 A

[58] Field of Search ..... 165/104.16, 104.18; 34/57 A; 122/4 D

[56] References Cited

U.S. PATENT DOCUMENTS

| | | | |
|---|---|---|---|
| 2,550,722 | 5/1951 | Rollman | 165/104.16 |
| 2,715,018 | 8/1955 | Lapple et al. | 165/104.16 |
| 4,651,807 | 3/1987 | Newby | 165/104.16 |

*Primary Examiner*—Albert W. Davis, Jr.
*Attorney, Agent, or Firm*—D. C. Abeles

[57] ABSTRACT

A method and apparatus for cooling of hot waste gases using a jetting bed, fluidized bed technique. A nozzle or plurality of nozzles inject the hot waste gases upwardly into a bed of solid particulate material contained in a housing, with the jet of hot gases fluidizing the bed and being dissipated therein without substantially disturbing the surface of the bed of solids. With use of a horizontally extending bed, a plurality of nozzles are spaced such that the jets of hot waste gases do not impinge upon one another. With use of a vertically extending housing, a single jet of hot waste gases may be used. The hot solids in the enclosure may be removed therefrom, cooled and returned, or heat transfer tubes may be provided in the housing, out of the area of contact of hot waste gases, to remove heat therefrom.

4 Claims, 4 Drawing Sheets

METHOD AND APPARATUS FOR COOLING A HIGH TEMPERATURE WASTE GAS USING A JETTING BED, FLUIDIZED BED TECHNIQUE

CROSS-REFERENCE TO RELATED INVENTION

This is a division of application Ser. No. 711,321 filed Mar. 13, 1985, now U.S. Pat. No. 4,651,807 granted Mar. 24, 1987.

Reference is made to the application of the present inventor, filed on even date herewith, Ser. No. 711,326, now U.S. Pat. No. 4,580,618 (W.E. Case No. 52,467) entitled "Method and Apparatus for Cooling a High Temperature Waste Gas Using a Radiant Heat Transfer Fluidized Bed Technique".

BACKGROUND OF THE INVENTION

The present invention relates to a fluidized bed technique for use in cooling high temperature waste gases from industrial processes. Heat recovery may be effected from the hot waste gases, which are of a temperature in excess of about 800° C.

It has previously been proposed to use fluidized bed technology for heat recovery from hot waste gases of various industrial processes. Problems are associated with the use of fluidized bed cooling of waste gases, such as, for example; (1) the fluidized bed gas distributor is prone to deposition and plugging and mechanical failure due to contact with the waste gases and contaminants therein, and such distributors are expensive, complex fabrication items, (2) heat transfer tubes (heat transfer surfaces) in such fluidized beds are also prone to corrosion, erosion, and fouling in hot, dirty, fluidized bed environments, (3) inefficient heat recovery is achieved due to the need for gas precooling by dilution in some systems and well-mixed, single-stage heat transport behavior, and (4) the particular material used in the fluidized bed may agglomerate due to deposition, resulting in potential bed defluidization or clinker formation.

It is an object of the present invention to provide a method and apparatus using fluidized bed techniques that solve the aforementioned four major problems and provide an efficient means for cooling of hot waste gases. In the present invention, high temperature waste gases are distributed into a fluidized bed by use of a large jet nozzle or series of such jet nozzles. The jets of high temperature waste gas are dissipated in the supply of solid particulate material that forms the fluidized bed. Where heat transfer tubes are present in the region of the fluidized bed, such tubes are not subjected directly to the hot waste gases, minimizing corrosion and fouling concerns. The present fluidized bed technique can be coupled with conventional staged fluidized bed heat exchanges for high overall heat recovery effectiveness, depending upon the deposition nature of the waste gas.

SUMMARY OF THE INVENTION

An apparatus and method for cooling a flow of high temperature waste gases using jet injection of the gases into a fluidized bed of solid particulate material contained in a housing.

In a preferred embodiment, a supply of solid particulate material is contained within a horizontally extending housing and a plurality of nozzles inject the high temperature waste gases into the solid particulate material as a plurality of spaced jets to fluidize the bed of material, such that the surface of the bed of material is substantially undisturbed while the gases dissipate through the solids and are cooled, the cooled gases exhausted from the top of the housing. The hot solids, heated by contact with the gases, are cooled by charging cool solids to one end of the housing and removing hot solids from the other end of the housing, and cooling the solids outside the housing and returning them for recycle. Or, a heat transfer fluid conduit can be used along the walls of the housing through which coolant is passed and the hot solids are cooled by transfer of heat to the coolant through the walls of the conduits. The preferred coolant is water which can be converted to steam by the heat from the solids and used as a supplemental energy source.

In a further embodiment of the present apparatus, a vertically extending housing is provided with a gas nozzle directing a jet of high temperature waste gases into a supply of solid particulate material in the housing. The gases fluidize the bed and are cooled and dissipated in the supply of solid particulate material without substantially disturbing the surface of the bed of solid particulate material. The heat of the hot solid particulate material is removed either by passing the solids through the housing and cooling them outside the housing or by heat transfer to a coolant passed through heat exchange tubes disposed in the housing. Where heat exchange tubes are used in the vertically extending housing, the tubes are positioned between the wall of the housing and a hollow cylindrical member spaced from the nozzle and coaxial therein, such that the high temperature waste gases pass upwardly through the hollow cylindrical member and the heat exchange tubes are protected therefrom.

DETAILED DESCRIPTION

The present invention uses a fluidized bed technique for cooling of a high temperature waste gas and heat recovery therefrom. The term "high temperature" is used to denote temperatures in excess of about 800° C., which temperatures cause difficulties in conventional fluidized bed heat recovery systems, and waste gas temperatures of up to about 1550° C. should be acceptable to the present cooling system.

Figure 1:
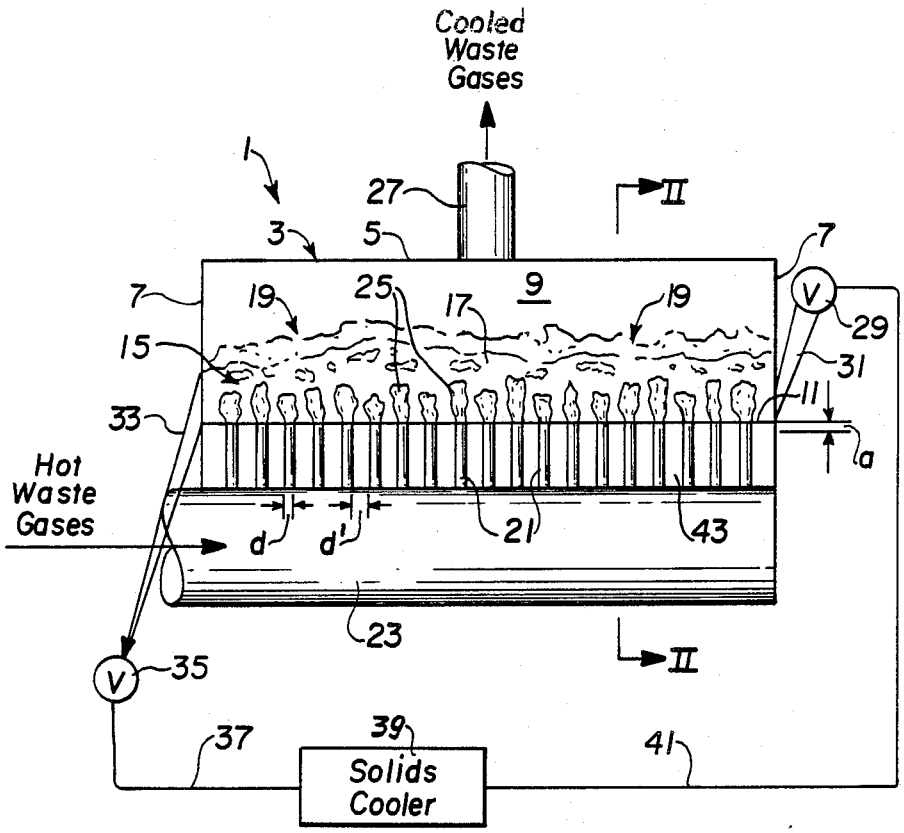
FIG. 1 is a vertical cross-sectional view of an embodiment of the present apparatus for use in the present method, where flow of solid particulate material through the housing is effected with the solids cooled outside the housing.
Figure 2:
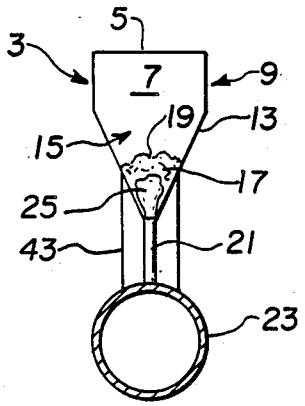
FIG. 2 is a view taken along lines II—II of FIG. 1.

Referring now to FIGS. 1 and 2, an embodiment of the apparatus 1 of the present invention is illustrated using a horizontally extending housing 3 having a closed top wall 5, end walls 7, side walls 9 and bottom wall 11. The side walls 9 have downwardly and inwardly tapering lower sections 13 which form a trough-like chamber 15. A bed of solid particulate material 17 is provided in the trough-like chamber of the housing 3, the bed 17 having an upper surface 19 spaced from the closed bottom wall 11. A plurality of spaced gas injection nozzles 21 communicate with the chamber 15, and a high temperature waste gas distributor duct 23 charges waste gas from a source through the gas injection nozzles 21 into the chamber 15 to fluidize the bed of solid particulate material 17 contained therein. The jets 25 of hot waste gas fluidize the solid particulate material, as illustrated, and are dissipated in the fluidized bed without substantially disturbing the surface 19 of the bed 17. Although there will always be some bubbling affect and some splashing of solid particulate material from the bed surface, the term "not substantially disturbing the surface of the bed" is used to designate that the disturbance of the bed surface is controlled such that solid particulate material is not discharged, directly by the jet of gases, from the housing along with the exhaust gases from the housing. An exhaust duct 27 is provided in the top wall 5 of the housing 3, such that waste gases, after cooling by contact with the solid particulate material is exhausted from the housing 3.

The heat is removed from the supply of solid particulate material 17 by effecting a flow of the supply of solids through the housing 3, discharging hot solid particulate material therefrom while adding replacement cooled solid particulate material thereto. As illustrated, cool solid particulate material is charged, as through a valve 29 into a chute 31 and then into the housing 3 at one end 7 thereof. The material is moved from that end 7 to the other end 7 of the housing 3 and is then discharged through a second chute 33 from the housing 3. A further valve 35 is used to direct the hot solid particulate material through line 37 to a solids cooler 39. In the solids cooler 39, the heat from the hot particulate material is reclaimed. The cooled solid particulate material may then be passed through line 41 back to the valve 29 for recycle to the housing 3. In order to assist in transfer of the solid particulate material from the charging end to the discharge end of the housing 3, the bottom wall 11 may be slightly inclined to the horizontal, an amount of about 3°, as shown by angle a, downwardly from the charging end to the discharge end.

In the jetting fluid bed method, the high temperature waste gases pass through the distributor duct 23 and upwardly through the gas injection nozzles 21. Vertical jets 25 of waste gas issue from each nozzle 21. The nozzles 21 can be refractory lined or ceramic tubes positioned in a header 43 along the bottom of the trough-like chamber 15 in the housing 3. High temperature waste gas issues from each nozzle as a vertical jet 25, providing fluidization for the bed 17 of solid particulate material and high axial solids mixing rates. In order to assure that the jets 25 are separate and do not overlap each other, the distance d' between adjacent nozzles 21 should be at least twice the interior diameter d of the nozzles. The size of the nozzles and rate of flow of waste gases therethrough are selected such that jets 25 are provided that do not penetrate through the surface 19 of the bed of solid particulate material 17, while the depth of the bed 17 of solid particulate material is selected to achieve an acceptable waste gas pressure drop.

Figure 3:
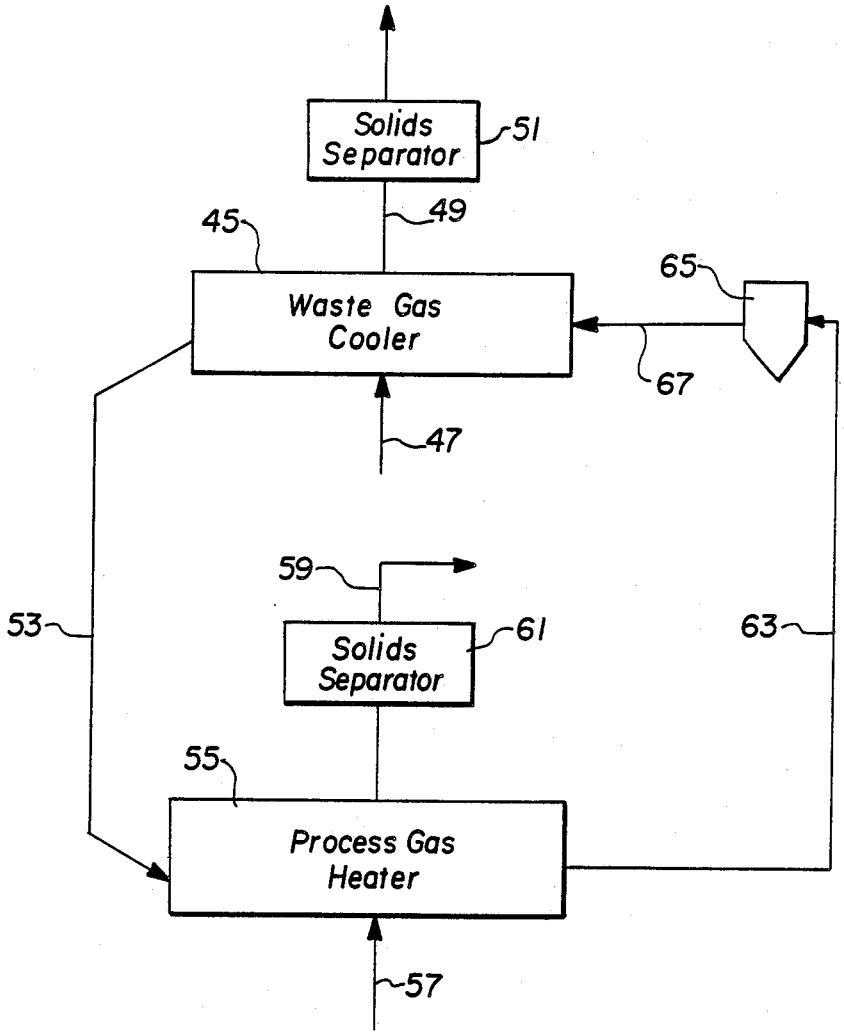
FIG. 3 is a flow diagram schematically illustrating an embodiment of the present invention where an apparatus as illustrated in FIG. 1 is used to cool hot waste gases, and the hot solids discharged from the housing are used in a second housing to heat process gas prior to return to the housing.

The incorporation of the apparatus described in FIG. 1 into a system for heating air for use in a process, from which the hot waste gases eventually are removed for cooling is illustrated schematically in FIG. 3.

As shown, the waste gas cooler 45, such as apparatus 1 of FIG. 1, has the high temperature waste gases charged thereto through line 47 and, after cooling, discharged therefrom through line 49 which may contain a solids separator 51 for particulate control. The cooled gas is then discharged through a stack (not shown) to the atmosphere. By cooling of the high temperature waste gas, solid particulate matter in the waste gas cooler becomes heated and is discharged through line 53 to a heat recovery unit 55. The heat recovery unit 55 can be the same construction as waste gas cooler 45, except that in this instance, it is used to transfer heat from hot solid particulate material to a cool gas flow. Cool gas, such as process air, that is to be heated for use in the process from which the high temperature waste gases are removed, or for some other purpose, is charged to the heat recovery unit 55 through line 57 and, after heating of the gas by contact with the hot solid particulate material, discharged through line 59, which may contain a solids separator 61, and is fed to the process wherein heated air is required. The solid particulate material, after cooling through contact with the process gas, is discharged from the process gas cooler 55 through line 63 and returned to a supply, such as a hopper 65, from which cooled solid particulate material is charged through line 67 to the waste gas cooler 45.

Figure 4:
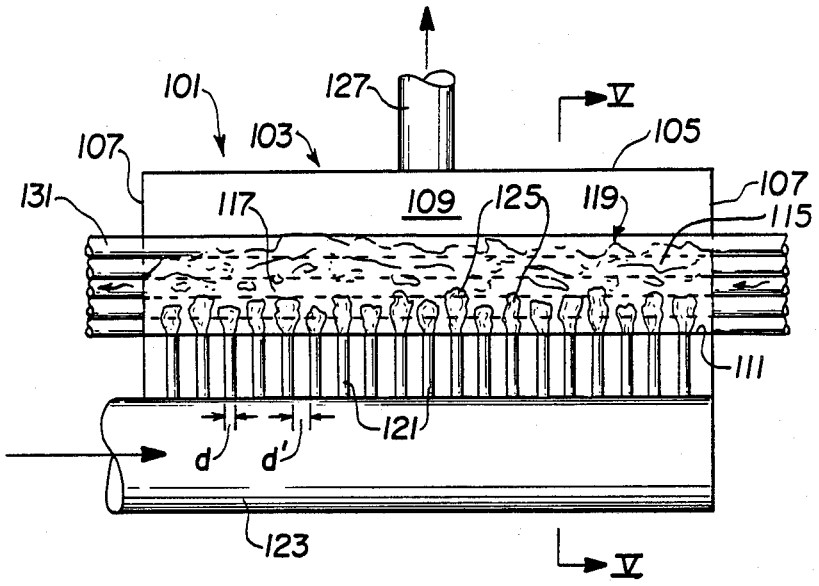
FIG. 4 is a vertical cross-sectional view of another embodiment of the present invention for use in the present method, where heat exchange tubes are provided along the wall of a horizontally extending housing to remove heat from the solid particulate material.
Figure 5:
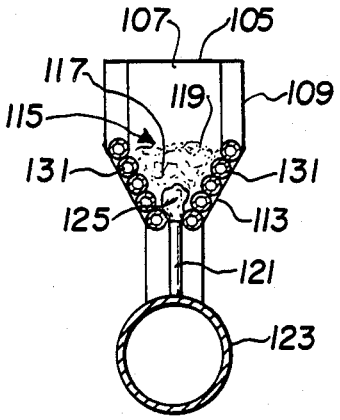
FIG. 5 is a view taken along the lines V—V of FIG. 4.

Another embodiment of the present invention is illustrated in FIGS. 4 and 5, wherein the means for removing heat from the solid particulate material of the bed of material comprises heat transfer tubes along the side walls of the housing. As illustrated, the apparatus 101 comprises a horizontally extending housing 103 having a closed top wall 105, end walls 107, side walls 109 and bottom wall 111. The side walls 109 have downwardly and inwardly tapering lower sections 113 which form a trough-like chamber 115. A bed of solid particulate material 117 is provided in the trough-like chamber 115 of the housing 103, the bed 117 having an upper surface 119 spaced from the closed bottom wall 111. A plurality of spaced gas injection nozzles 121, fed from waste gas distributor duct 123, inject jets 125 of waste gas into the bed 117 of solid particulate material to fluidize the same. An exhaust duct 127 exhausts cooled gas from the housing 103.

In this embodiment, the means for removing heat from the solid particulate material of bed 117 comprises heat transfer fluid conduits 131. The heat transfer fluid conduits or tubes are positioned along the side walls 109 of the housing 103, at least in the area of the downwardly and inwardly taper portion 113 thereof which forms the chamber 115 containing the fluidized bed of solid particulate material. Means (not shown) for passing a coolant such as water through the heat transfer fluid conduits are provided, as are means (not shown) for removing the heated coolant from the conduits. Where water is used as the coolant, steam is generated which can be used as a supplemental energy source. The heat transfer fluid conduits 131 are provided along the side walls 109 or may form a section of the side walls 109 as illustrated in FIG. 5. The bed 117 of solid particulate material, while in a fluidized state, does not move from one end of the housing 103 to the other end and the heat is removed by indirect contact with the coolant through the walls of the heat transfer fluid conduits 131.

The dimensions of the apparatus vary dependent upon the temperature and flow rate of the high temperature waste gases being treated. It is estimated that for a waste gas stream at a temperature of about 1550° C., flowing at a rate of about 4,248 standard cubic meters/-hours, using the apparatus of FIGS. 1 and 2, the housing would be about 12 meters long and about 1 meter wide and 1.5 meters in height. A cooled waste gas at about 820° C. would be generated, as well as a stream of solid particulate material (alumina spheres) at about 1200°0 C., flowing at a rate of 43,00 kilograms/hr that could be used for air preheating.

Figure 7:
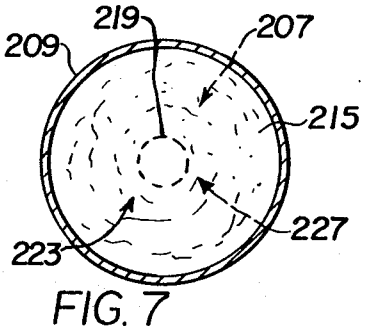
FIG. 7 is a view taken along the line VII—VII of FIG. 6.
Figure 6:
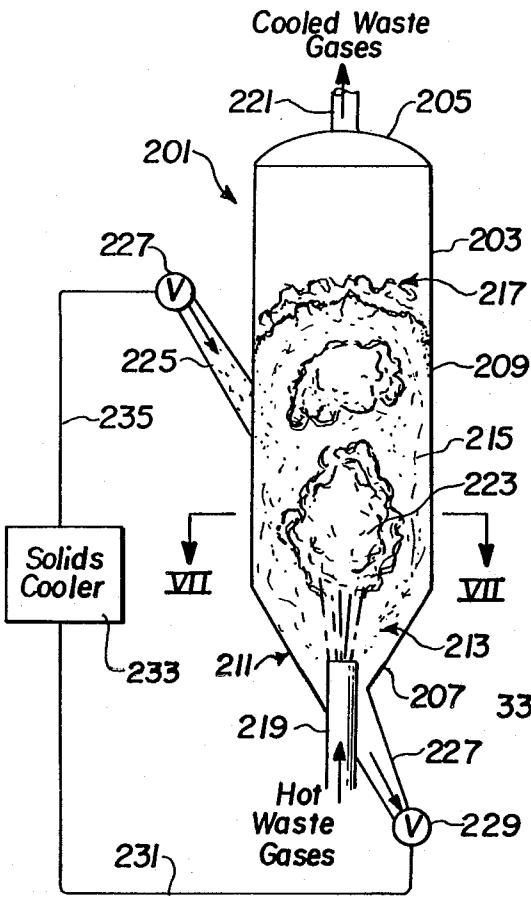
FIG. 6 is a vertical cross-sectional view of a further embodiment of the present apparatus for use in the present method where the housing is a vertically extending housing and solid particulate material is charged to and discharged from the housing, with the solids cooled outside the housing.

Further embodiments of the present invention utilizing a deep bed fluidization technique are illustrated in FIGS. 6 through 9. In these embodiments, the housing is a vertically extending housing with a jet of hot waste gases fed to a bed of solid particulate material contained in the bottom of the housing. Such a vertically extending housing is usable where higher pressure drops are permissible. Referring now to FIGS. 6 and 7, an apparatus 201 comprises a vertically extending housing 203 having a closed top wall 205, a closed bottom wall 207 and vertically extending side and end walls 209, the housing preferably of a cylindrical-like shape, such that the side and end walls are continuous, with the side and end walls 209 all tapering downwardly at the lower portion 211 thereof to form a conical-shaped trough or chamber 213. A bed of solid particulate matter 215 is contained within the chamber 213, the bed of material 215 having an upper surface 217. A jet nozzle 219 extends through the bottom wall 207 of the housing 203, and an exhaust duct 221 is provided in the top wall 205. A jet 223 of high temperature waste gas is injected through nozzle 219 into the bed of solid particulate 215 to fluidize the same, and is dissipated therein, without substantially disturbing the surface 217 of the bed. The high temperature waste gases are cooled by contact with the solid particulate material and pass upwardly therethrough and are discharged from the housing through the exhaust duct 221. Heat is removed from the solid particulate material 215 by effecting a flow of the supply of solids through the housing, discharging hot solid particulate material therefrom while adding replacement cool solid particulate material thereto. As illustrated, cool solid particulate material is charged through a chute 225, such as by means of a valve 227, into the housing 203 through a sidewall 209. The charged cool solid particulate material is added to the bed 215 and is heated by the high temperature gases. Hot solid particulate material is removed from the bottom 207 of the housing 203 through a discharge chute 227. A valve 229 in chute 227 directs the hot solid particulate material through line 231 to a solids cooler 233. The heat from the hot solid particulate material is reclaimed in the solids cooler 233, and the cooled solid particulate material passed through line 235 back to the valve 227 for recycle to the housing 203.

Figure 8:
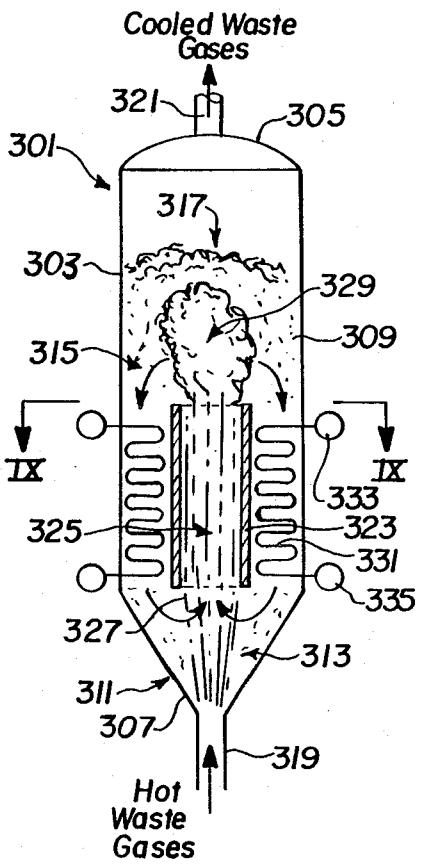
FIG. 8 is a vertical cross-sectional view of another embodiment of the present invention using a vertically extending housing, for use with the present method where heat exchange tubes are disposed in the housing between the wall and a hollow cylindrical member to remove heat from the solid particulate material.
Figure 9:
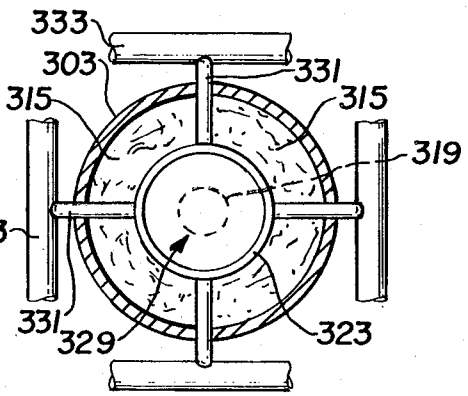
FIG. 9 is a view taken along the lines IX—IX of FIG. 8.

In FIGS. 8 and 9, another embodiment is illustrated wherein the heat is removed from the solid particulate material by means of heat exchange tubes carrying a coolant. The apparatus 301, comprises a vertically extending housing 303 with a closed top 305, closed bottom wall 307 and vertically extending side and end walls 309. As illustrated, the housing is preferably cylindrically shaped, with the side and end walls 309 tapering downwardly at the lower portion 311 thereof to form a conical-shaped trough or chamber 313. Solid particulate material 315 is contained therein having an upper surface 317. A jet nozzle 319 extends through the bottom wall 307 and an exhaust duct 321 is provided in top wall 305. A hollow cylindrical member 323 is positioned in the housing 303 at a location spaced from the jet nozzle 319 and coaxial therewith, such that the jet nozzle, injecting the waste gases into the housing, directs the jet of gases 325, into the cylindrical tube, at 327, and upwardly therethrough, with the jet of gases fluidizing the bed of solid particulate material. As shown, the jet of gases, while fluidizing the bed of solids above the cylindrical member 323, as at 329, is dissipated within the bed of solid particulate material without substantially disturbing the surface 317 of the fluidized bed of material. In order to remove heat from the solid particulate material of the bed 315, heat transfer fluid conduits or tubes 331 are positioned between the walls 309 of the housing 303 and the hollow cylindrical member 323. The tubes 331 pass through the wall 309 and a coolant, such as water is fed to the tubes through headers 333 and discharged from the tubes through headers 335.

In this embodiment, the hot waste gases are injected through the jet nozzle 319, upwardly through the hollow cylindrical member 323 to fluidize the bed of solid particulate material 315 and is dissipated therein, without substantially disturbing the surface 317 of the bed, and cooled, and discharged through the exhaust duct 321. Solid particulate material, heated by the waste gases, fall by gravity through the region between the cylindrical member 323 and the walls 309 of the housing, with heat thereof transferred through conduits 331 to the coolant. The cooled material flows by gravity and hydrostatic forces to the bottom of the housing and is enveloped in the jet of hot waste gases and directed with the gases upwardly through the hollow cylindrical member 323 to replenish the bed of solid particulate material in the fluidized bed above the hollow cylindrical member. The hollow cylindrical member 323 provides for separation of the jet 325 of high temperature waste gases from the heat transfer surface of the tubes 331 and a highly controllable internal bed circulation is provided.

In the present invention, the solid particulate material is a solid material that is stable at the temperatures used. Alumina powder, for example, is a suitable material. The solid particulate material should have a particle size of between about 50 to 1000 microns in diameter to enable ready fluidization of the same in the fluidized beds.

In some instances, where removal of a pollutant from the waste gas, as well as cooling, is desired, a solid absorbent for the pollutant can be added to the bed of solid particulate material, and removed and regenerated for reuse, or discarded. For example, lime or limestone particles could be added to absorb sulfur dioxide, and the spent lime or limestone removed, regenerated, and returned to the housing.

The present apparatus minimizes problems of gas distributor plugging and mechanical failures; tube (heat transfer surface) corrosion, erosion and fouling, and bed particulate material agglomeration problems associated with conventional fluidized bed cooling systems.

The present invention, using a jetting bed system, avoids the problems associated with gas distributors in conventional fluidized bed coolers by using a small number of large pipe nozzles which are not generally subject to plugging or mechanical failure. The system does not require waste gas dilution to protect the distributor, and promotes highly effective cross-flow heat transfer. Bed material agglomeration is avoided by the high velocity jet which tends to break apart particle agglomerates that are swept into the jet.

What is claimed is:

1. An apparatus for cooling high temperature waste gas comprising:

a vertically extending trough-shaped housing having downwardly and inwardly tapering end walls and side walls at the lower portion thereof terminating at a closed bottom, to form a cylindrically-shaped housing;

a bed of solid particulate material disposed in said trough-shaped housing having an upper surface spaced from said closed bottom;

at least one gas injection nozzle communicating with said housing at said closed bottom;

means for injecting high temperature waste gases upwardly through the gas injection nozzle into the bed of solid particulate material to fluidize said bed, such that the jet of hot waste gas is dissipated in said fluidized bed without substantially disturbing the surface thereof, and said gas is cooled by contact with said solids;

means for discharging cooled waste gases from said housing after passage through the bed of solid particulate material;

means for charging cooled solid particulate material into said housing in said bed, at a location spaced from said bottom wall for passage downwardly therethrough;

means for discharging heated solid particulate material from the bottom wall of said housing;

means for cooling said heated solid particulate material outside said housing; and means for returning said cooled particulate material to said means for charging.

2. A method of cooling a stream of high temperature waste gases comprising:

directing a stream of high temperature waste gases into a bed of solid particulate matter contained in a vertically extending trough-shaped, housing having vertically extending side and end walls with downwardly and inwardly tapering end walls and side walls at the lower portion thereof terminating at a closed bottom, to form a cylindrically shaped housing, through at least one nozzle in said bottom, as a jet, upwardly through said bed of solid particulate material to fluidize the same and dissipate therein, and cool the waste gases by contact with said solid particulate material, without substantially disturbing the upper surface of said bed;

discharging said stream of cooled waste gases from said housing; and removing heat from the bed of solid particulate material by charging cool solid particulate material into the housing through a side wall thereof and removing hot solid particulate material from said bottom, cooling the removed solid particulate material outside the housing, and returning cooled particulate material for charging to said housing through said side wall.

3. The method as defined in claim 2 wherein said high temperature waste gases are at a temperature of between about 800° to 1550° C.

4. The method as defined in claim 2 wherein said solid particulate material comprises alumina powder having a particle size of between about 50 to 1000 microns in diameter.

* * * * *